US005707323A

United States Patent [19]

Simonson

[11] Patent Number: 5,707,323

[45] Date of Patent: Jan. 13, 1998

[54] METHOD AND APPARATUS FOR EXERCISING THE REAR DELTOID MUSCLE

[76] Inventor: Roy Simonson, Cybex Division of Lumex, Inc., 2840 Janitell Rd., Colorado Springs, Colo. 80906

[21] Appl. No.: 401,819

[22] Filed: Mar. 10, 1995

[51] Int. Cl.[6] ..... A63B 21/00; A63B 23/02

[52] U.S. Cl. ..... 482/97; 482/136

[58] Field of Search ..... 482/72, 94–100, 482/130, 133–139, 5, 112, 113, 129

[56] References Cited

U.S. PATENT DOCUMENTS

| | | | |
|---|---|---|---|
| Re. 35,470 | 3/1997 | Jones | 482/97 |
| D. 262,812 | 1/1982 | Lambert, Jr. et al. . | |
| D. 321,026 | 10/1991 | Jones . | |
| 3,858,873 | 1/1975 | Jones . | |
| 3,948,513 | 4/1976 | Pfotenhauer . | |
| 3,998,454 | 12/1976 | Jones . | |
| 4,333,340 | 6/1982 | Elmeskou | 482/134 X |
| 4,629,185 | 12/1986 | Amann | 482/113 |
| 4,711,450 | 12/1987 | McArthur | 482/5 |
| 4,757,992 | 7/1988 | Heitsch et al. . | |
| 4,773,398 | 9/1988 | Tatom | 482/139 X |
| 4,799,670 | 1/1989 | Williamson . | |
| 4,807,877 | 2/1989 | Buxton . | |
| 4,846,458 | 7/1989 | Potts . | |
| 4,911,435 | 3/1990 | Johns . | |
| 5,050,872 | 9/1991 | Farenholtz . | |
| 5,125,881 | 6/1992 | Jones . | |
| 5,135,449 | 8/1992 | Jones . | |
| 5,304,107 | 4/1994 | Jones | 482/100 |
| 5,454,773 | 10/1995 | Blanchard et al. | 482/136 X |

FOREIGN PATENT DOCUMENTS

| | | |
|---|---|---|
| 1745271 A1 | 1/1990 | U.S.S.R. . |
| 925678 | 5/1963 | United Kingdom . |

OTHER PUBLICATIONS

Cybex Div. of Lumex, Inc., "Cybex Strength Systems", Brochure, pp. II–6 and V–14, 1993.

Cybex Div. of Lumex, Inc., "Cybex Cable Column", Brochure, Jan. 1994.

Nautilus Sports/Medical Industries, Inc., "Leverage Machines by Nautilus Instruction Manual", Brochure, pp. 8–9, 16 & 17.

Nautilus Sports/Medical Industries, Inc. "Nautilus Powerplus", Brochure.

Hammer Strength, Hammer Strength Picture Price List, Oct. 1994.

Lamb Bodybuilding Machines, "Four–Bar Heavy–Duty Plate–Loaded Variable–Resistance Bodybuilding Machines", Brochure, p. 4.

Cybex Div. of Lumex, Inc., "Eagle Fitness Systems by Cybex," Brochure, pp. 7, 14 & 15.

Cybex Div. of Lumex, Inc., "Eagle Performance Systems, The New Standard of Excellence," Brochure, pp. 6, 7 & 13.

Cybex Div. of Lumex, Inc., "Cybex Strength Systems, a Body of Work" (VR), Brochure, 1989/1990.

Cybex Div. of Lumex, Inc., "Cybex Strength Systems", Service and Parts Manual, p. 13, 1992.

(List continued on next page.)

*Primary Examiner*—Lynne A. Reichard
*Assistant Examiner*—John Mulcahy

[57] ABSTRACT

A method and apparatus for exercising the rear deltoid muscle is disclosed. The apparatus comprises a seat and a chest pad that are adjustably mounted to a frame to form a user support. Two arms are independently pivotally mounted at a first end by hinges to the frame. A handle is mounted to each arm whereby an exerciser grips the handle to use the apparatus. A means for resisting the movement of the handle is provided which is adapted to affect the force required to move the handles. According to the method, a seated exerciser grasps at least one handle and moves it outwardly and pulls it towards himself so that the handle moves in a substantially arcuate path towards the exerciser's shoulders.

15 Claims, 4 Drawing Sheets

OTHER PUBLICATIONS

Cybex Div. of Lumex, Inc., "Cybex Personal Power Station 200", Brochure.
Cybex Div. of Lumex, Inc., "Cybex Strength Systems Owner's Manual", p. 1, Brochure.
Cybex Div. of Lumex, Inc., "Cybex Extremity Systems, The Cybex 6000 Extremity System", Brochure, 1991.
Cybex Div. of Lumex, Inc., "Cybex Testing and Rehabilitation Systems", Brochure, 1993.
Cybex Div. of Lumex, Inc., "Cybex Strength Systems", Brochure, 1993.
Cybex Div. of Lumex, Inc., "Cybex Liftask: Lifting Capability Screening & Training System", Brochure, 1988.
Nautilus Sports/Medical Industries, Inc., "Nautilus Instruction Manual", Brochure, pp. 21 & 23, 1980.
Nautilus Sports/Medical Industries, Inc., "Machine Operating Manual: Instructions for Use, Maintenance Tips, Warranties, Parts", Brochure, p. 17.
Nautilus Sports/Medical Industries, Inc., "Nautilus Weight Assisted Chin-Up/Dip Station", Flyer, 1992.
Nautilus Sports/Medical Industries, Inc., "Nautilus Midwest New Products", Brochure.
Atlantic Fitness Products, "Specialists in Physical Fitness and Health Equipment", Brochure, 1985.
Bodymasters, "Expect the Best", Brochure.
Loredan Biomedical, Inc., "Lido Loredan, a New Vision of Strength Training," Brochure, pp. 8–9, 1990.
Muscle Dynamics, "Maxicam by Muscle Dynamics", Product Listing, Brochure.
Universal Gym Equipment, Inc., "Universal Conditioning Machines and Free Weights", Brochure.
Berkson, Michael, et al., "Voluntary Strengths of Male Adults with Acute Low Back Syndrome", Clinical Orthopaedics and Related Research, No. 129, pp. 84–95.
"Swivel Grip" Brochure. 6 pages.

METHOD AND APPARATUS FOR EXERCISING THE REAR DELTOID MUSCLE

FIELD OF THE INVENTION

The invention relates generally to the field of exercise and physical rehabilitation, and, in particular, to a method and apparatus for exercising the shoulders.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance.

Various routines have been developed to exercise different muscle groups by forcing the muscles to contract and extend under a load, such as by moving a free weight against the force of gravity or by moving a handle whose movement is resisted by an exercise machine. For example, routines have been developed to exercise the rear portion of the deltoid muscle, commonly referred to as the rear deltoid. To exercise the rear deltoid using dumbbells, an exerciser typically bends forward at the waist, grasping a dumbbell in each hand. In the rest position, the hands are positioned close together in front of the exerciser's body and aligned vertically below the exerciser's head. The arms are slightly bent at the elbow. To begin the exercise, the arms are drawn upward with the elbows rising in an arcuate path to about the level of exerciser's shoulders. The arms are then lowered along the same path to complete the exercise. Performing this exercise with dumbbells can stress the exerciser's lower back.

Machines have been developed that supposedly allow an exerciser to exercise the rear deltoid muscle. One such machine, described in U.S. Pat. No. 5,125,881, includes a bench and pivotal levers connected to a frame on opposite sides of the bench. The levers are described as independently pivotal, in an upward direction, through a shoulder adductive motion by an exerciser lying face down on the bench. Each lever includes a hub for holding removable weights, and further includes an actuating pad that is acted upon by the exerciser to pivot the lever. An exerciser lying face down on the bench places his elbows against pads and then adducts the shoulders to pivotally raise the levers against the weight held on the hubs. The pivot points of the arrangement should be aligned with the shoulders for maximum muscular benefit and comfort. Since the position of the actuating pads and pivot points are not adjustable, optimal alignment will only be achieved for those exercisers having a certain shoulder width and arm length. Furthermore, many exercisers find it unpleasant to lie face down on a bench to use a piece of exercise equipment.

Thus, there is a need for a method and apparatus for exercising the rear deltoid muscle that more readily allows the exerciser, regardless of size, to adopt a desirable alignment relative to the apparatus to more effectively exercise the muscle.

SUMMARY OF THE INVENTION

An object of the present invention to provide a method and apparatus to exercise the rear deltoid muscle that allows a plurality of exercisers, having a wide range in height, arm length and shoulder width, to each adopt a substantially optimal alignment relative to the apparatus to maximize the effectiveness of the exercise.

A further object of the present invention is to provide a method and apparatus for exercising the rear deltoid muscle that allows the use of free weights to provide resistance.

Another object of the present invention is to provide a method and apparatus for exercising the rear deltoid muscle in a seated position.

A further object of the present invention is to provide a method and apparatus for exercising the rear deltoid muscle using the hands.

A further object of the present invention is to provide a relatively light weight apparatus for exercising the rear deltoid muscle.

A method and apparatus for exercising the rear deltoid muscle is disclosed. In an exemplary embodiment, the apparatus comprises a seat and a chest pad that are adjustably mounted to a frame to form an exerciser support. Two arms are independently pivotally mounted at a first end by hinges to the frame. A handle is mounted to each arm whereby an exerciser grips the handle to use the apparatus. A means for resisting the movement of the handle is provided which is adapted to provide a resistive force to the movement of the handles.

In an exemplary embodiment of a method according to the present invention, an exerciser loads weight plates onto posts that are mounted to arms. The exerciser then straddles a seat and adjusts the seat and a chest pad such that the exerciser's arms are straight as he grasps at least one handle. The exerciser then moves the handle outwardly and pulls it towards himself so that the handle moves in a substantially arcuate path towards the exerciser's shoulders, causing the weight plates to be displaced.

BRIEF DESCRIPTION OF THE DRAWINGS

Further features of the invention will become more apparent from the following detailed description of specific embodiments thereof when read in conjunction with the accompanying drawings, in which.

DETAILED DESCRIPTION

Figure 1:
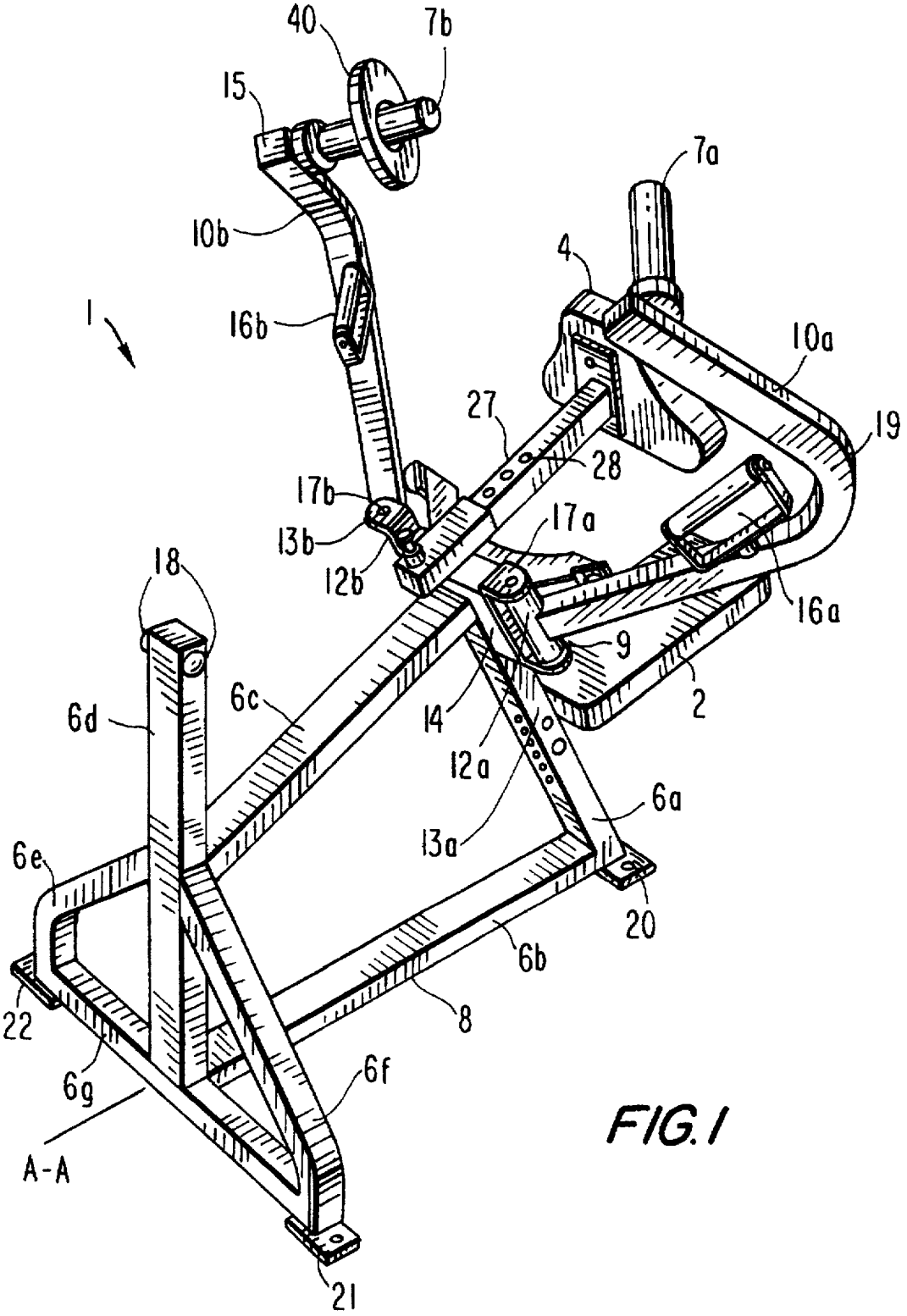
FIG. 1 is a perspective view of an embodiment of a rear deltoid exercise machine of the present invention showing the arms in an extended position.

FIG. 1 is a perspective view of an embodiment of the rear deltoid exercise machine 1 of the present invention. A seat 2 and a chest pad 4 are preferably adjustably mounted to a frame member **6*a* to form an exerciser support. The frame member 6*a*, in conjunction with frame members 6*b*–6*g*, forms a frame 8. A vertical plane A—A (see FIGS. 1 & 4) defines a line of symmetry for the rear deltoid exercise machine 1 along the frame member 6*c* and telescoping rod 27. Thus, the frame 8 is characterized by a first and a second lateral side on opposite sides of the vertical plane A—A, a front end nearest the frame member 6*a* and a back end nearest the frame member 6*d*. As discussed further below, two arms 10a, 10b are independently pivotally mounted at a first end 9 by hinges 13a, 13b to the frame 8. The arm 10a is disposed on the first lateral side of the frame 8; the arm 10b is disposed on the second lateral side. The frame 8 and arms 10a, 10b** are preferably formed of steel, such as 11 gauge mild square or rectangular steel.

A handle 16a, 16b is preferably rotatably mounted to each of the arms 10a, 10b, respectively. The handle is located on the arm so that it is in plane B—B (see FIG. 2). The rotation or swivel of the handles 16a, 16b allows an exerciser to grip the handles at a comfortable or appropriate angle dictated by the exerciser's arm length and shoulder width, and the positioning of the chest pad 4 and the seat 2. Further, during the exercise stroke, the exerciser can maintain a comfortable grip on the handles 16a, 16b without bending his wrists, despite the movement of the arms 10a, 10b.

A post 7a, 7b is mounted on each arm 10a, 10b near the second end 15 of the arm. The posts 7a, 7b are sized to receive weights, such as a plate 40, which increase the resistance of the exercise provided by the rear deltoid machine 1. Other means may be operably engaged to the arms 10a, 10b to resist their movement and exercise the user's muscles including hydraulic, pneumatic, electric or magnetic resistance, a weight stack, springs, elastic bands, friction or an air resistance fan, or any combination of these. Preferably, the posts 7a, 7b are slanted up, relative to the surface, e.g. the floor, on which the machine 1 rests to better retain weight plates during use. Such an upward slant may be achieved in several ways. As described in more detail below, the hinges 13a, 13b are angled toward the back end of the frame as well as toward the vertical plane A—A. Such angles cause the posts 7a, 7b to adopt an increasingly upward slant, relative to the horizontal, as the arms 10a, 10b are moved toward the exerciser. The posts 7a, 7b may therefore be disposed on the arms 10a, 10b such that the posts assume a horizontal position when the arms are in a rest position along side the frame member 6c. Thus, weights may be easily placed on the posts 7a, 7b due to the horizontal position of the posts when in their rest position, and will be better retained on the posts during use since the posts adopt an upward slant relative to the horizontal, by virtue of the hinge angles, as the arms 10a, 10b are moved toward the exerciser. Alternatively, the posts 7a, 7b may be disposed on the arms 10a, 10b such that the posts have an upward slant.

Figure 2:
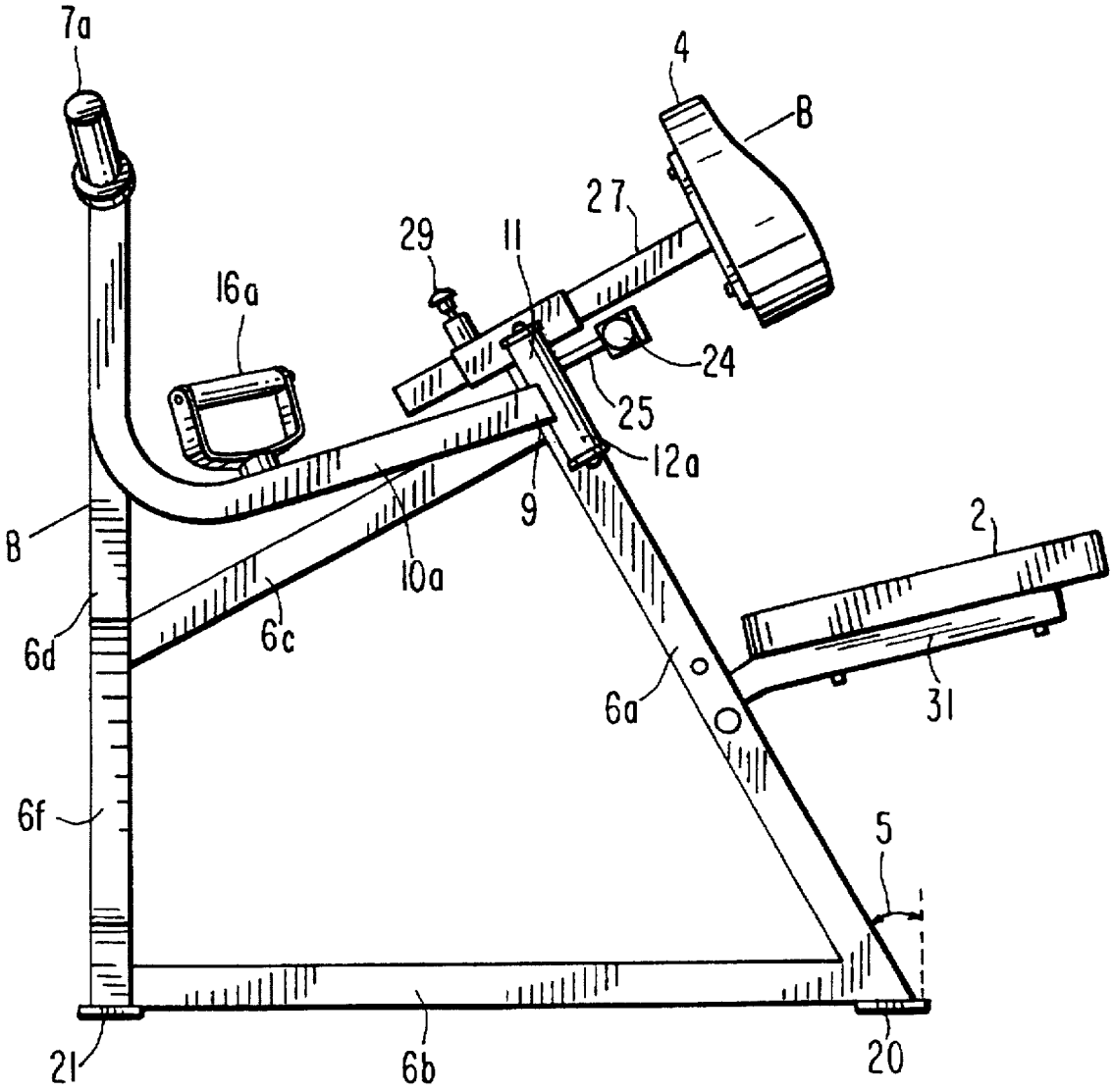
FIG. 2 is a side view of the exercise machine of FIG. 1 showing the arms in a rest position.

As previously noted, the seat 2 and the chest pad 4 position are preferably adjustable to compensate for individual variation in torso length and arm length. As shown in FIGS. 1 and 2, a telescoping rod 27 with holes or detents 28 and pin 29 may be used to adjust the chest pad position. The seat 2 is pitched to provide a comfortable and stable support for the exerciser. The seat may be mounted to the frame by means of a telescoping rod with holes or detents and a pin. The seat height may also be adjusted using a rack and tooth arrangement, or by other means well known in the art. In an alternative embodiment, the present invention can be practiced without a seat so that the exerciser is standing or kneeling on the floor, with his chest supported against the chest pad 4. As will be appreciated by those skilled in the art, the frame height may be adjusted appropriately for such alternate embodiments.

Figure 3:
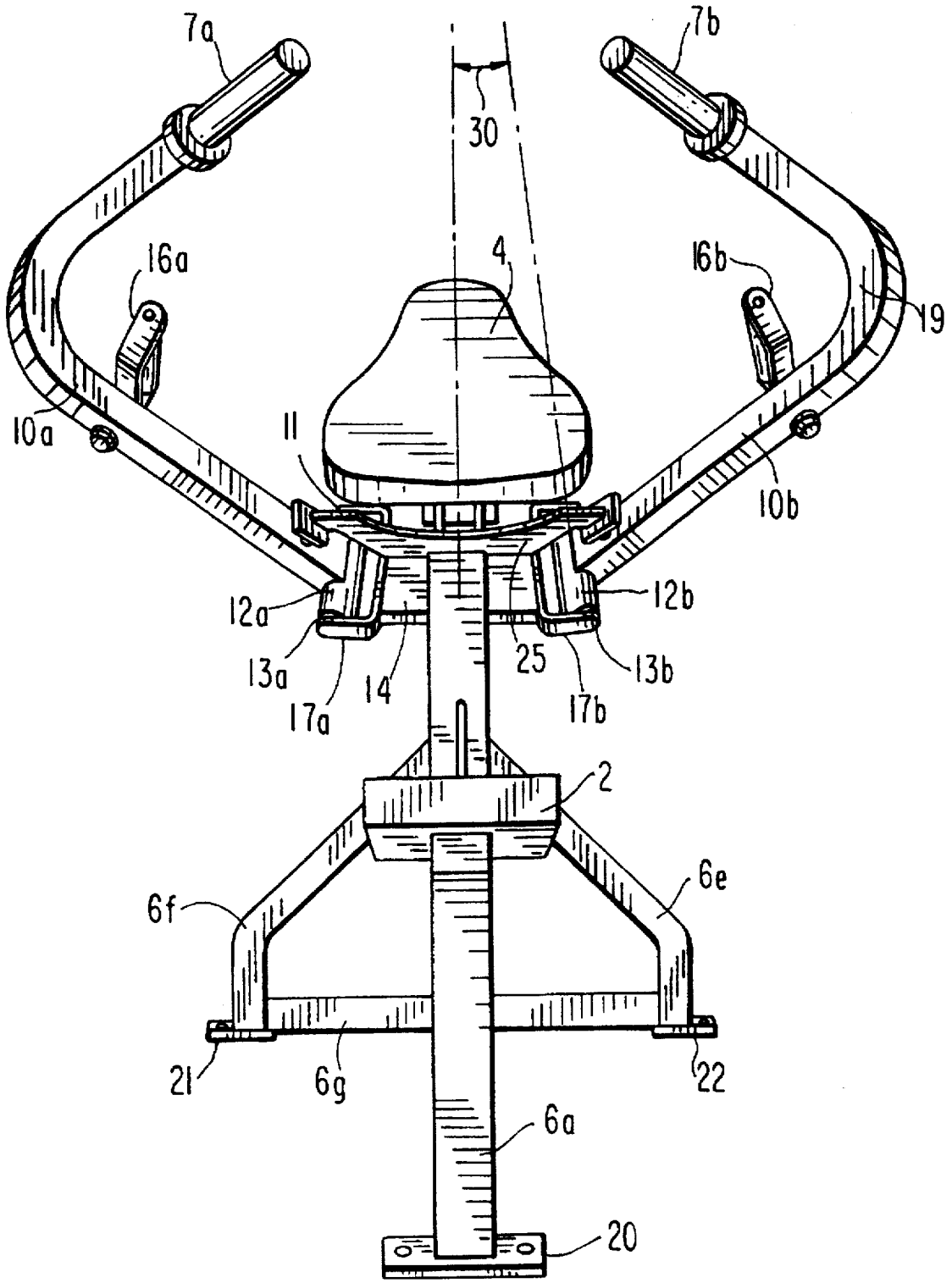
FIG. 3 is a rear view of the exercise machine of FIG. 1 showing the arms in an extended position.
Figure 4:
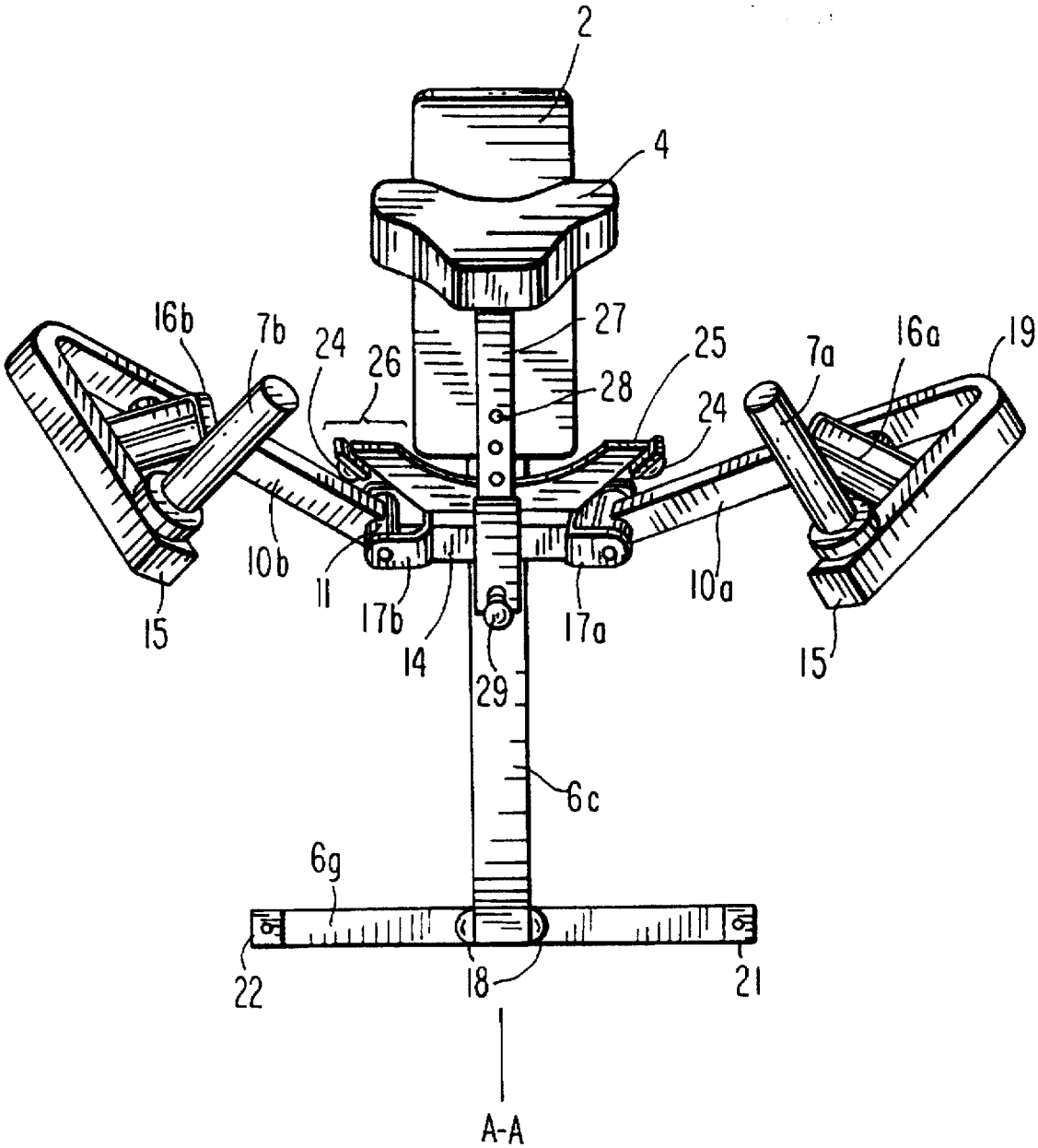
FIG. 4 is a top view of the exercise machine of FIG. 1 showing the arms in an extended position.

As shown in FIG. 2, the frame member 6a is pitched toward the back end of the frame 8. The angle of the pitch relative to the vertical, designated by the reference numeral 5, is preferably about 30°. Furthermore, as shown in FIGS. 3 and 4, the hinges 13a, 13b are angled so that the upper end 11 of the hinges is disposed toward the vertical plane A—A. Preferably, the angle of hinges 13a, 13b relative to the vertical, designated by the reference numeral 30, is about 6°. The angles 5 and 30 define the resistance profile of the machine 1. Since the hinges 13a, 13b are angled as described, the movement of the exerciser's arms during exercise is substantially in a plane that contains the exerciser's shoulders, such as plane B—B in FIG. 2. Further, the orientation of the hinges creates a resistance profile that initially increases as the handles are pulled toward the exerciser and decreases at the last portion of the exercise stroke.

The arm 10a is attached, preferably by welding, to the bearing tube 12a on the first lateral side of the frame. Likewise, the arm 10b is attached to the bearing tube 12b on the second lateral side of the frame. Within the bearing tubes are an axle and sealed bearings, not shown. The sealed bearings are preferably model #87503 metric bearings, manufactured by Fafnir, or an equivalent. The axle, sealed bearings and bearing tube collectively form a hinge, such as the hinges 13a, 13b. The hinges 13a, 13b are supported by brackets 17a, 17b, respectively. The brackets 17a, 17b are attached to a connector member 14 which is, in turn, connected to the frame 8. The hinges 13a, 13b work independently of each other so that an exerciser may exercise one arm at a time, which is particularly advantageous for rehabilitation work.

In a first exemplary embodiment, the arms 10a, 10b, have a single bend 19, dividing the arms into a first part beginning at the end 9 and terminating at the bend, and a second part beginning at the bend and terminating at the end 15. The handles 16a, 16b are preferably located on the first part of the arms near the bend 19. The bend in the arms 10a, 10b cause them to curve in an upward direction. Due to the hinge angle 30, the posts 7a, 7b have slight upward tilt which aids in preventing weights from falling off the posts. Such an upward tilt could, of course, be provided by mounting the posts at a slight upward angle on the arms or in other ways known to those skilled in the art. In a second exemplary embodiment, not pictured, the arms 10a, 10b may have two bends. In such an embodiment, beginning from the end 9, the first part of the arms are oriented substantially perpendicular to the vertical plane A—A. The first section extends for a few inches, and then bends approximately 90 degrees to begin a second part, oriented substantially parallel to the vertical plane A—A. As in the first embodiment, this part terminates in a bend which causes the arms to curve in an upward direction. The handle is located near the upward bend at the terminus of the second part. The third part of the arm is the same as in the first exemplary embodiment. In both embodiments of the arms 10a, 10b, the arms are shaped and the posts 7a, 7b are mounted so that the posts are located between the waist and shoulders of the typical exerciser, making it easy to place weights on the posts.

Bumpers 18 are mounted on the sides of the upper end of the frame member 6a. The bumpers are formed of a compliant substance such as rubber. When in their rest position, the arms 10a, 10b abut the bumpers 18. Frame members 6a, 6e and 6f are supported at their lower ends by plate members 20, 21 and 22, respectively. Preferably, bolt holes are provided in the plate members to allow the machine 1 to be secured during transit or for normal use. As shown in FIG. 4, a member 25, in conjunction with stops 24, form a range of motion stop 26 which limits the range of motion of the exercise machine 1. While the range of motion stop 26 is shown to be non-adjustable, in an alternate embodiment, an adjustable range of motion stop could be used.

The rear deltoid exercise machine 1 is operated as follows. Weights are placed on the posts 7a, 7b. The height of the seat 2 is adjusted so that the exerciser's chest is aligned with the chest pad 4. The chest pad 4 is adjusted so that the exerciser's arms are substantially fully extended to grasp the handles 16*a*, 16*b* when the arms 10*a*, 10*b* are in their rest position against the bumpers 18. The exerciser sits on the seat, places his chest against the chest pad 4 and grasps the handles 16*a*, 16*b*. The exerciser pulls out and towards himself, moving the arms 10*a*, 10*b*, and any weights mounted on the posts, in an arcuate path. Thus, to effect this movement, the exerciser must move the "weighted" arms 10*a*, 10*b* against the resistance afforded by gravity on the weight plates in view of the 6 degree hinge angle 18 and the 30 degree frame angle 5. In a preferred embodiment, rotatable handles permit the exerciser to minimize stress on the wrists as the arms 10*a*, 10*b* are pulled toward the exerciser. FIG. 2 shows the arms 10*a*, 10*b* in the rest position, while FIGS. 1, 3 and 4 show the arms 10*a*, 10*b* drawn toward the front end of the frame as the rear deltoid is being exercised.

It should be understood that the embodiments and variations shown and described herein are illustrative of the principles of this invention and that, in view of these teachings, modifications may occur to, and be implemented by, those skilled in the art without departing from the scope and spirit of the invention.

I claim:

1. An apparatus for exercising the rear deltoid muscle of a user comprising:

a frame having a first and a second lateral side, a lateral center, a front end and a back end;

a chest pad mounted to the front end of the frame for engaging the chest of a user facing the back end of the frame;

a first hinge mounted to the frame on the first lateral side of the frame proximate the chest pad, said first hinge having a top and a bottom;

a first arm pivotally mounted to the first hinge;

a first handle mounted to the first arm distal the first hinge; and means for resisting movement of the first arm;

wherein the top of said first hinge is angled toward the lateral center of the frame and toward the back end of the frame such that the movement of the first handle is adapted for exercise of the rear deltoid muscle of a user engaging the chest pad and first handle.

2. The exercise apparatus of claim 1 wherein the top of the first hinge is angled toward the back end of the frame at an angle of about 30° from vertical.

3. The exercise apparatus of claim 1 wherein the top of the first hinge is angled toward the lateral center of the frame at an angle of about 6° from vertical.

4. The exercise apparatus of claim 1 further comprising:

a second hinge mounted to the second lateral side of the frame proximate the chest pad, said second hinge having a top and a bottom;

a second arm pivotally mounted to the second hinge;

a second handle mounted to the second arm distal the second hinge; and means for resisting movement of the second arm;

wherein the top of said second hinge is angled toward the lateral center of the frame and toward the back end of the frame such that the movement of the second handle is adapted for exercise of the rear deltoid muscle of a user engaging the chest pad and second handle.

5. The exercise apparatus of claim 1 wherein said chest pad has a top and a bottom, wherein the top of the chest pad is angled toward the back end of the frame.

6. The exercise apparatus of claim 1 wherein said resistance means comprises:

a first post mounted to said first arm distal the first hinge;

wherein said first post is adapted to receive a weight.

7. The exercise apparatus of claim 1 further comprising a range of motion stop adjustably mounted to the front end of the frame to selectively limit motion of the first arm.

8. An apparatus for exercising the rear deltoid muscle of a user comprising:

a frame having a first and a second lateral side, a lateral center, a front end and a back end;

a chest pad mounted to the front end of the frame for engaging the chest of a user facing the back end of the frame;

a first hinge mounted to the first lateral side of the frame, said first hinge having a top and a bottom;

a second hinge mounted to the second lateral side of the frame, said second hinge having a top and a bottom;

a first arm pivotally mounted to the first hinge;

a second arm pivotally mounted to the second hinge;

a first handle mounted to the first arm distal the first hinge;

a second handle mounted to the second arm distal the second hinge;

means for resisting movement of the first and second arms;

wherein the tops of said first and second hinges are angled toward the lateral center of the frame and toward the back end of the frame such that the movement of the handle is adapted for exercise of the rear deltoid muscle of a user engaging the chest pad and handles.

9. The exercise apparatus of claim 8 wherein the tops of the first and second hinges are angled toward the back end of the frame at an angle of about 30° from vertical.

10. The exercise apparatus of claim 8 wherein the tops of the first and second hinges are angled toward the lateral center of the frame at an angle of about 6° from vertical.

11. The exercise apparatus of claim 8 wherein said resistance means comprises:

a first post mounted to said first arm distal the first hinge; and a second post mounted to said second arm distal the second hinge;

wherein said first and second posts are adapted to receive a weight.

12. The exercise apparatus of claim 8 further comprising a range of motion stop adjustably mounted to the front end of the frame to selectively limit motion of the first and second arms.

13. An apparatus for exercising the rear deltoid muscle of a user comprising:

a frame having a first and a second lateral side, a lateral center, a front end and a back end;

a chest pad mounted to the front end of the frame for engaging the chest of a user facing the back end of the frame;

a first arm pivotally mounted to the first lateral side of the frame such that the first fixed arm pivots about a first pivot axis;

a second arm pivotally mounted to the second lateral side of the frame such that the second fixed arm pivots about a second pivot axis;

a first handle rotatably mounted to the first arm distal the frame;

a second handle rotatably mounted to the second arm distal the frame;

means for resisting movement of the first and second arms;

wherein said first and second pivot axes are angled vertically towards the back end of the frame and towards the lateral center of the frame such that the movement of the handle is adapted for exercise of the rear deltoid muscle of a user engaging the chest pad and handles.

14. The exercise apparatus of claim 13 wherein said chest pad has a top and a bottom, wherein the top of the chest pad is angled toward the back end of the frame.

15. The exercise apparatus of claim 13 wherein said first and second pivot axes are angled vertically toward the lateral center of the frame at an angle of about 6° from vertical.

* * * * *

UNITED STATES PATENT AND TRADEMARK OFFICE

CERTIFICATE OF CORRECTION

PATENT NO. : 5,707,323

DATED : January 13, 1998

INVENTOR(S) : Simonson

It is certified that error appears in the above-identified patent and that said Letters Patent is hereby corrected as shown below:

Column 6, line 61-62
the first [fixed] arm pivots about a first fixed pivot axis;

Column 6, line 64-65
the second [fixed] arm pivots about a second fixed pivot axis;

Signed and Sealed this

Twenty-ninth Day of December, 1998

*Attest:*

*Attesting Officer*

Bruce Lehman

BRUCE LEHMAN

*Commissioner of Patents and Trademarks*